US008500116B2

(12) United States Patent
Nakayama

(10) Patent No.: US 8,500,116 B2
(45) Date of Patent: Aug. 6, 2013

(54) IMAGE PROCESSING DEVICE AND SHEET FEEDER MECHANISM

(75) Inventor: Hiroyuki Nakayama, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/406,729

(22) Filed: Feb. 28, 2012

(65) Prior Publication Data

US 2012/0223476 A1 Sep. 6, 2012

(30) Foreign Application Priority Data

Mar. 1, 2011 (JP) ..... 2011-043884

(51) Int. Cl.
*B65H 3/52* (2006.01)

(52) U.S. Cl.
USPC ..... 271/122; 271/125

(58) Field of Classification Search
USPC ..... 271/122, 125
See application file for complete search history.

(56) References Cited

U.S. PATENT DOCUMENTS 4,627,607 A * 12/1986 Ishii ..... 271/122
5,351,945 A * 10/1994 Asakawa et al. ..... 271/118
5,449,162 A * 9/1995 Saito et al. ..... 271/122
5,497,986 A * 3/1996 Kudo ..... 271/122
5,564,689 A * 10/1996 Fukube ..... 271/122
5,996,990 A * 12/1999 Kawashima ..... 271/122
7,384,034 B2 * 6/2008 Nagura et al. ..... 271/125

FOREIGN PATENT DOCUMENTS

JP 6191670 A 7/1994
JP 2001106371 A 4/2001
JP 2001294335 A 10/2001
JP 2003081470 A 3/2003
JP 2003118862 A 4/2003
JP 2003246478 A 9/2003
JP 2008037639 A 2/2008
JP 2009018891 A 1/2009

* cited by examiner

*Primary Examiner* — David H Bollinger
(74) *Attorney, Agent, or Firm* — Lowe Hauptman Ham & Berner, LLP

(57) ABSTRACT

A drop in performance can be easily resolved when the retard roller becomes worn. A hopper disposed to a main unit stores sheets in a stack. A conveyance path conveys sheets from the hopper. A feed roller is disposed facing the conveyance path. A retard unit has a retard roller is disposed opposite the feed roller with the conveyance path therebetween, and a torque limiter connected coaxially to the retard roller. An urging means urges the retard unit so that the retard roller presses against the feed roller. The retard unit is removably installed to the main unit.

17 Claims, 6 Drawing Sheets

IMAGE PROCESSING DEVICE AND SHEET FEEDER MECHANISM

Priority is claimed under 35 U.S.C. §119 to Japanese Application No. 2011-043884 filed on Mar. 1, 2011, which is hereby incorporated by reference in its entirety.

BACKGROUND

1. Technical Field

The present invention relates to an image processing device that forms images on checks, recording paper, and other sheet media or reads images on the sheet media, and relates more particularly to a sheet feeder mechanism for separating and feeding sheets stored in a stack in the device into the sheet conveyance path.

2. Related Art

Image processing devices of this type normally have a media separation mechanism that prevents multifeeding of sheets stored in a stack into the sheet conveyance path. Japanese Unexamined Patent Appl. Pub. JP-A-2009-18891 teaches a mechanism that uses a retard roller as an example of such a media separation mechanism. This mechanism causes the sheets to be conveyed between a feed roller and a retard roller, which is pressed against the feed roller with a rotational load applied thereto. When overlapping sheets pass together between these rollers, the frictional force produced between the sheet on the retard roller side and the retard roller restricts feeding the sheet on the retard roller side.

In order to keep the pressure load of the retard roller on the separation roller at a desirable level, the counterforce of the sheet on the retard roller is supported by a guide surface for sliding the retard roller in a direction intersecting the sheet feeding direction. By using this construction, the retard roller support structure of JP-A-2009-18891 is made more complicated and the retard roller cannot be easily replaced.

As a result of producing a strong braking force, the retard roller also wears quickly. Such wear reduces the nipping strength and reduces the brake power, and is also related to problems such as sheet multifeeding and sheets not being fed. When this happens, the service life of the sheet feeder mechanism or the image processing device can also be affected if the retard roller cannot be easily replaced.

This problem is common to sheet feeder mechanisms and image processing devices that have a retard roller, and an object of the invention is to easily eliminate a drop in performance when the retard roller becomes worn.

SUMMARY

Preferred aspects of the invention solving at least part of the foregoing problem are described below.

One aspect of the invention is an image processing device that performs at least one of forming an image on sheets and reading an image from sheets, including: a main unit; a sheet storage unit that is disposed to the main unit and holds the sheets in a stack; a conveyance path for conveying the sheets in the sheet storage unit; a feed roller disposed facing the conveyance path; a retard unit including a retard roller disposed opposite the feed roller with the conveyance path therebetween, and a torque limiter coaxially connected to the retard roller; and an urging means that urges the retard unit so that the retard roller presses against the feed roller; wherein the retard unit is removably installed to the main unit.

This aspect of the invention enables replacing the retard roller by replacing the entire unit when the retard roller becomes worn because the retard roller is rendered as a unit that can be removed from the main unit.

In an image processing device according to another aspect of the invention, the main unit has a shaft extending in a direction intersecting the sheet feeding direction; an insertion hole is disposed to the retard unit; and the retard unit is supported pivotably on the shaft by inserting the shaft to the insertion hole.

This configuration enables easily installing and removing the retard unit in the main unit by fitting the insertion hole of the retard unit over the shaft.

In an image processing device according to another aspect of the invention, the shaft is disposed protruding up from the main unit; and the retard unit is installed to the main unit by fitting the insertion hole onto the shaft from above.

This configuration enables easily inserting the shaft to the insertion hole of the retard unit.

In an image processing device according to another aspect of the invention, the urging means includes a pressure plate that pushes the retard unit from the back side toward the feed roller, and an elastic member that urges the pressure plate toward the feed roller.

This configuration enables using a simple construction to press the retard unit to the feed roller.

An image processing device according to another aspect of the invention preferably also has a stop that is disposed to the main unit, and contacts the retard unit and prevents the retard unit from rising.

This configuration prevents the retard unit from separating and moving upward.

In an image processing device according to another aspect of the invention, the retard unit is urged by the urging means and engages the stop.

This configuration can easily cause the retard unit to engage the stop.

In an image processing device according to another aspect of the invention, the sheet storage unit stores the sheets upright; and the sheets are fed upright into the conveyance path.

This configuration enables disposing the retard unit with the axis of the retard roller vertical.

In an image processing device according to another aspect of the invention, the main unit has a first member with a vertical panel portion, and a second member disposed along the panel portion; the second member has a first part disposed opposite the panel portion with the space therebetween forming the sheet storage unit, and a second part disposed opposite the panel portion with the space therebetween forming the conveyance path; and the retard unit is disposed with at least part thereof located between the first part and the second part when seen from the sheet feeding direction.

Using this structure enables reducing the size of the sheet feeder mechanism when seen from the sheet feeding direction.

Another aspect of the invention is a sheet feeder mechanism for separating and feeding sheets stored in a stack in a main unit to a sheet conveyance path, including: a feed roller that is rotationally driven in the sheet feeding direction; a retard roller that contacts the feed roller from a position with the sheet conveyance path therebetween; a torque limiter that is connected to the retard roller and restricts rotation of the retard roller by torque less than or equal to a specific level; a case that holds the retard roller and torque limiter coaxially rotatable; an urging means that urges the case in a specific direction toward the feed roller; and an installation mechanism that enables removably installing the case to the main unit while enabling the case to pivot in the specific direction.

This configuration enables removably installing the retard roller to the main unit by removably installing the case to the main unit.

In a sheet feeder mechanism according to another aspect of the invention, the installation mechanism includes a shaft disposed to the main unit, and an insertion hole that is disposed to the case and enables inserting the shaft thereto.

This configuration enables rendering the installation mechanism more easily.

In a sheet feeder mechanism according to another aspect of the invention, the shaft is disposed vertically.

This configuration enables simply fitting the insertion hole of the case onto the shaft from above.

In a sheet feeder mechanism according to another aspect of the invention, rotational axis of the retard roller and torque limiter is parallel to the shaft.

This configuration enables using the shaft to pivotably support the case in a direction perpendicular to the rotational axis of the retard roller and torque limiter.

In a sheet feeder mechanism according to another aspect of the invention, the urging means includes a pressure plate that contacts the case from the specific direction, and a pressure spring disposed between the pressure plate and the main unit.

This configuration enables using a simple construction to evenly press the case holding the retard roller toward the feed roller.

In a sheet feeder mechanism according to another aspect of the invention, the pressure plate is pivotably attached to the main unit.

This configuration enables using a pressure spring at a single point to apply even pressure to the case by the pressure plate.

In a sheet feeder mechanism according to another aspect of the invention, a contact surface that contacts the pressure plate is disposed to the case.

This configuration enables evenly transferring the urging force of the pressure spring from the pressure plate to the case.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of the present invention is described below with reference to the accompanying figures.

Figure 1:
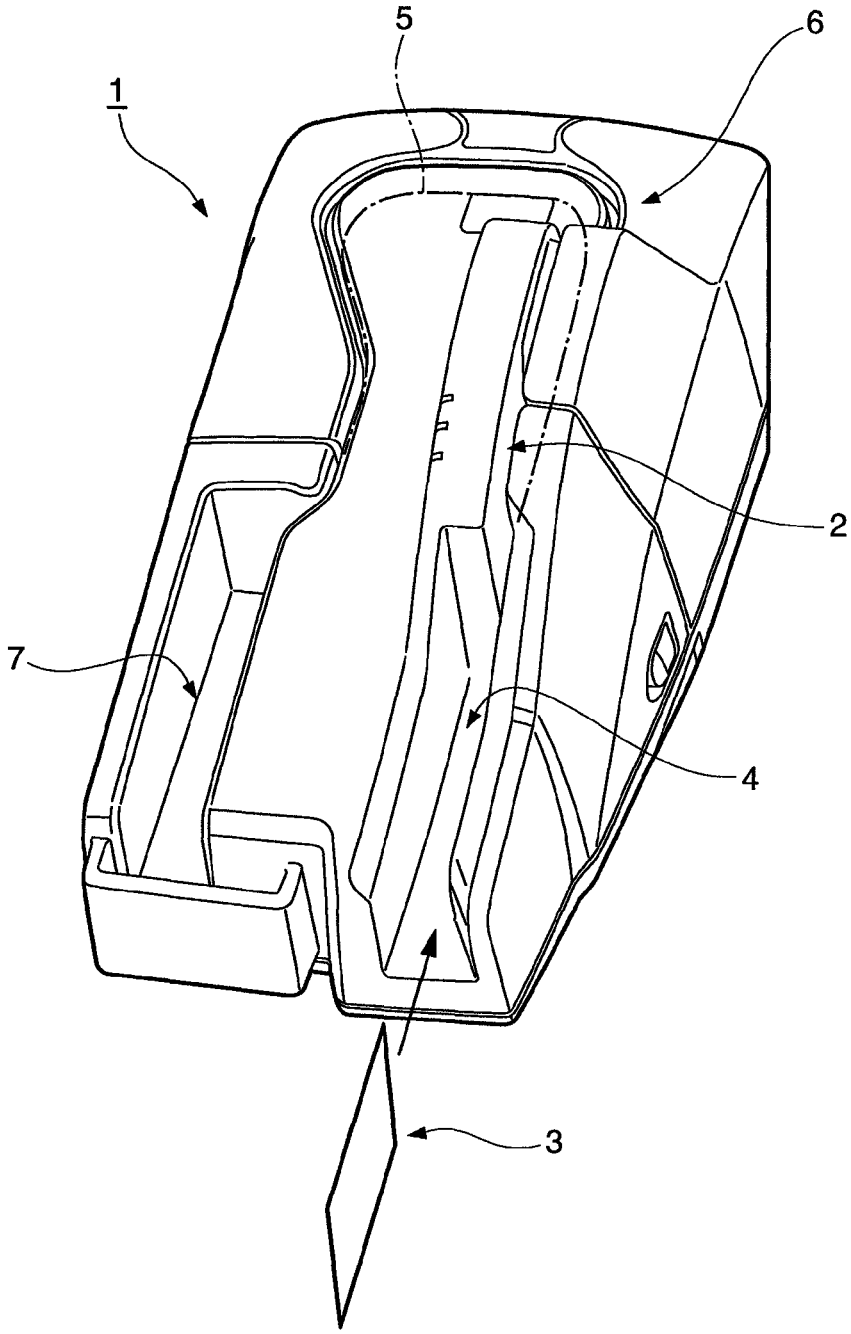
FIG. 1 is an external oblique view of a check processing device according to a preferred embodiment of the invention.

FIG. 1 is an external oblique view of a check processing device (image processing device) 1 according to a preferred embodiment of the invention. The check processing device 1 includes a hopper (sheet storage unit) 4 that holds a stack of checks or other sheets 3 standing on edge relative to the main unit 2; a conveyance path 5 that conveys a sheet 3 fed from the hopper 4; a processing unit 6 that, for example, prints images (forms images) on, reads data from, or scans the sheets 3 conveyed through the conveyance path 5; and a discharge unit 7 for receiving from the conveyance path 5 sheets 3 that have finished processing by the processing unit 6 and are discharged through the conveyance path 5.

Figure 2:
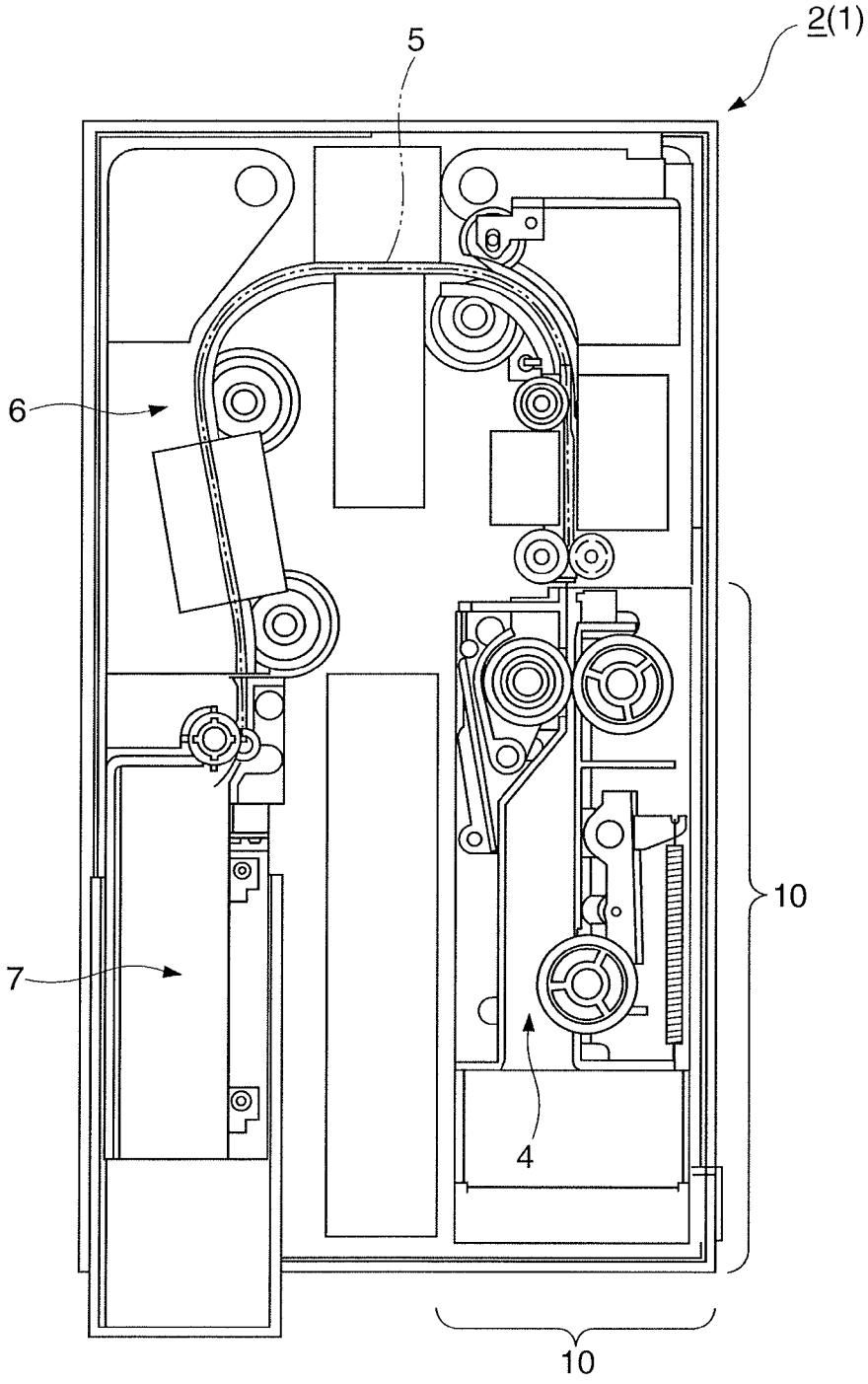
FIG. 2 is a plan view showing the inside of the check processing device shown in FIG. 1.

FIG. 2 is a plan view showing the inside of the main unit 2 of the check processing device 1. As shown in the figure, a sheet feeder mechanism 10 for feeding sheets 3 into the conveyance path 5 is formed inside the main unit 2 around the part where the hopper 4 is disposed.

Figure 3:
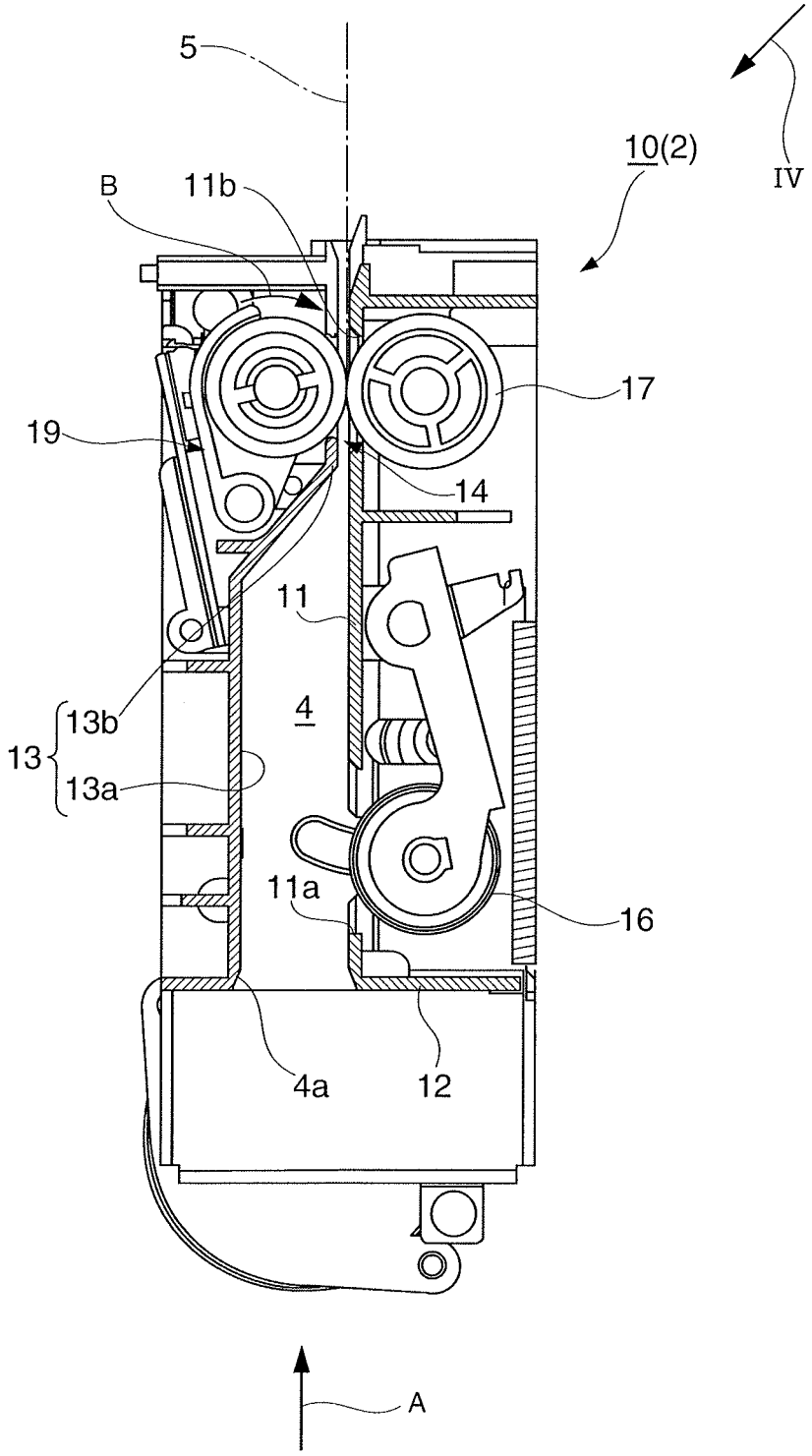
FIG. 3 is a plan view of the sheet feeder mechanism in the check processing device shown in FIG. 2.

FIG. 3 is a plan view showing the sheet feeder mechanism 10 of the main unit 2 in detail. As shown in the figure, the sheet feeder mechanism 10 has a first member 12 with a panel portion 11 disposed vertically, and a second member 13 disposed opposite the first member 12, rendering the hopper 4 between the first member 12 and second member 13.

The second member 13 includes a first part 13*a* rendering the part on the sheet 3 entrance 4*a* side to the hopper 4, and a second part 13*b* forming the part on the conveyance path 5 side, disposed in steps. By thus disposing the second member 13 along the panel portion 11 of the first member 12, the hopper 4 is formed between the panel portion 11 and the first part 13*a* separated therefrom, and an in-feed path 14 for feeding sheets 3 in the hopper 4 into the conveyance path 5 is formed between the panel portion 11 and proximally disposed to second part 13*b*.

A pickup roller 16 for separating the sheets 3 in the hopper 4, and a feed roller 17 for feeding the sheet 3 separated by the pickup roller 16 through the in-feed path 14 to the conveyance path 5, are disposed to the sheet feeder mechanism 10 (main unit 2). The pickup roller 16 is disposed near an opening 11*a* in the panel portion 11 of the first member 12, and can protrude through the opening 11*a* into the hopper 4. The feed roller 17 is disposed so that part thereof is exposed in the in-feed path 14 through an opening lib in the panel portion 11 at the in-feed path 14.

A retard unit 19 is disposed at a position opposite the feed roller 17 with the in-feed path 14 therebetween. The retard unit 19 is disposed so that part thereof fits in the step between the first part 13*a* and second part 13*b* of the second member 13, or more specifically so that part fits in the space between the first part 13*a* and second part 13*b* in the sheet conveyance direction (direction A in FIG. 3).

Figure 4:
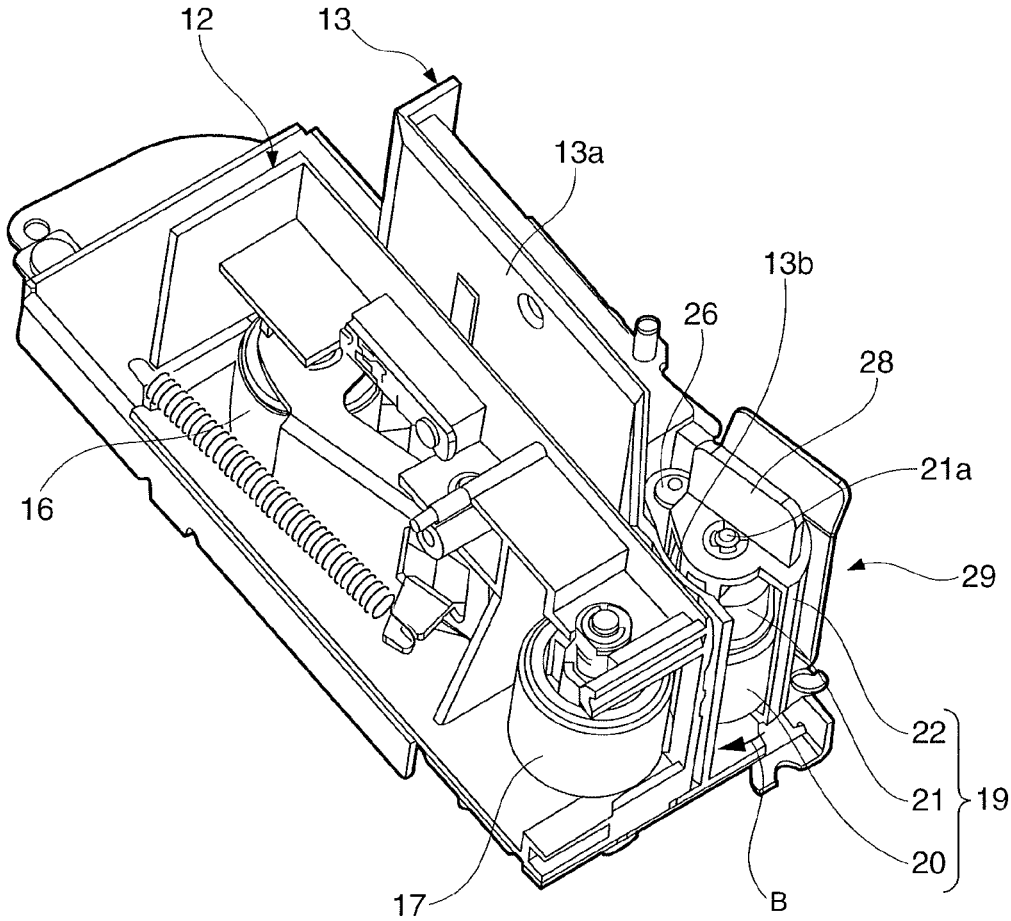
FIG. 4 is an oblique view of the sheet feeder mechanism shown in FIG. 3.

FIG. 4 is an oblique view of the sheet feeder mechanism 10 as seen from the direction of arrow IV in FIG. 3. The retard unit 19 includes a retard roller 20 that is pressed against the feed roller 17 from an opposing position with the in-feed path 14 therebetween, a torque limiter 21 connected coaxially to the retard roller 20, and a case 22 that houses the retard roller 20 and torque limiter 21.

The torque limiter 21 is formed so that the rotary shaft 21*a* thereof turns only when the applied torque exceeds a specific level. By connecting the rotary shaft 21*a* to the retard roller 20, rotation of the retard roller 20 is restricted by the torque limiter 21 when the torque on the retard roller 20 is less than the specific level.

Figure 5:
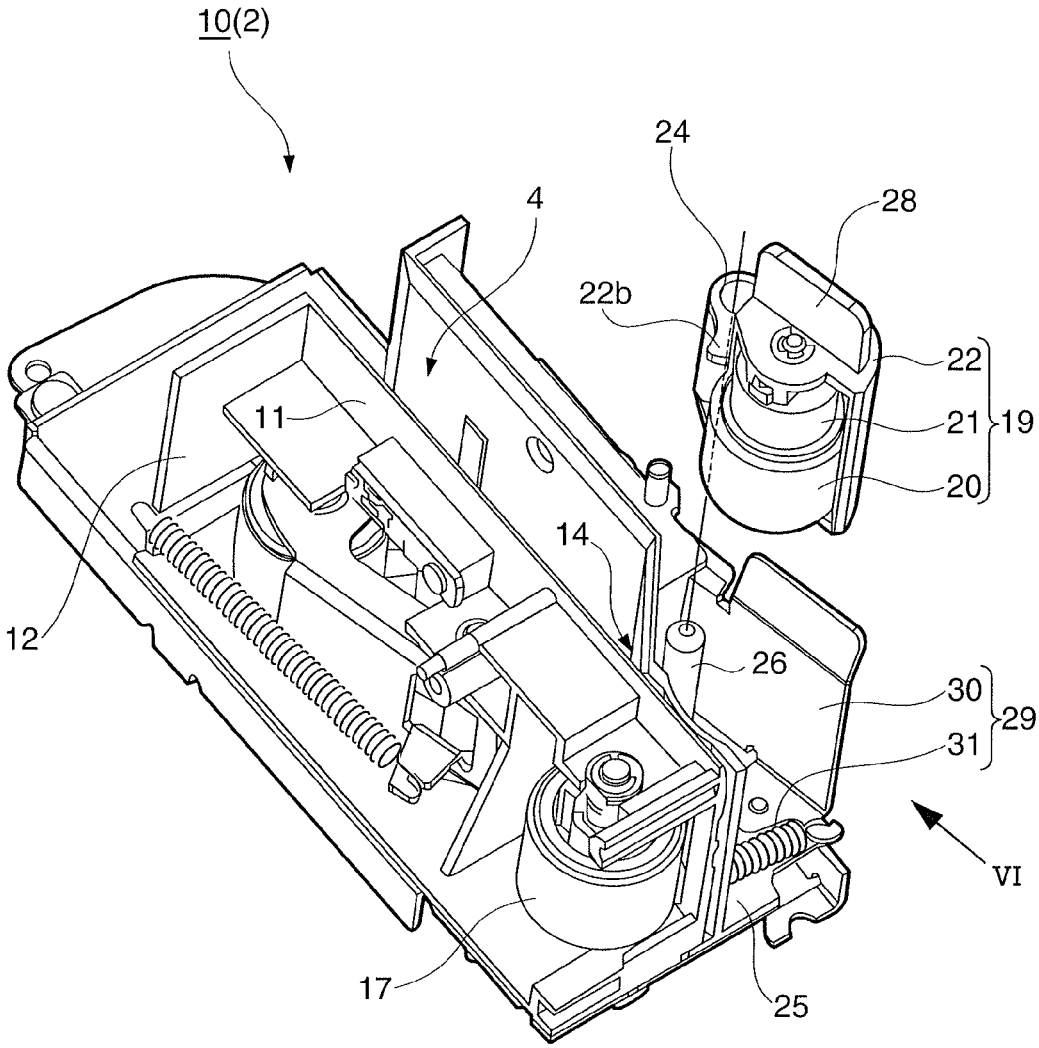
FIG. 5 is an exploded oblique view of the sheet feeder mechanism shown in FIG. 3.

FIG. 5 is an exploded oblique view of the sheet feeder mechanism 10. As shown in the figure, the retard unit 19 is removably installed to the sheet feeder mechanism 10 (main unit 2). The installation mechanism of the retard unit 19 is described next.

An insertion hole 24 is disposed to the case 22 of the retard unit 19 as a through-hole parallel to the axis of the retard roller 20 and torque limiter 21 (the vertical direction in the figure), and a post 26 is disposed rising vertically from the base 25 of the sheet feeder mechanism 10 (main unit 2). The retard unit 19 can be installed to the sheet feeder mechanism 10 by lowering the retard unit 19 to the sheet feeder mechanism 10 while inserting the post 26 to the insertion hole 24. Thus installed, the retard unit 19 can rotate in the direction of arrow B in FIG. 3 and FIG. 4 pivoting on the post 26. In addition, because the insertion hole 24 simply fits over the post 26, the retard unit 19 can also be easily removed from the sheet feeder mechanism 10. Note that a grip 28 is provided on the top of the case 22 of the retard unit 19, and the retard unit 19 can be easily installed and removed by holding the grip 28.

As shown in FIG. 4 and FIG. 5, an urging means 29 for urging the retard roller 20 to the feed roller 17 is disposed behind the retard unit 19 (the opposite side as the feed roller 17 as seen from the retard unit 19) as seen from the in-feed path 14 side. As shown in FIG. 5, the urging means 29 includes a pressure plate 30 disposed vertically, and a pressure spring (elastic member) 31 that urges the pressure plate 30 toward the in-feed path 14.

Figure 6:
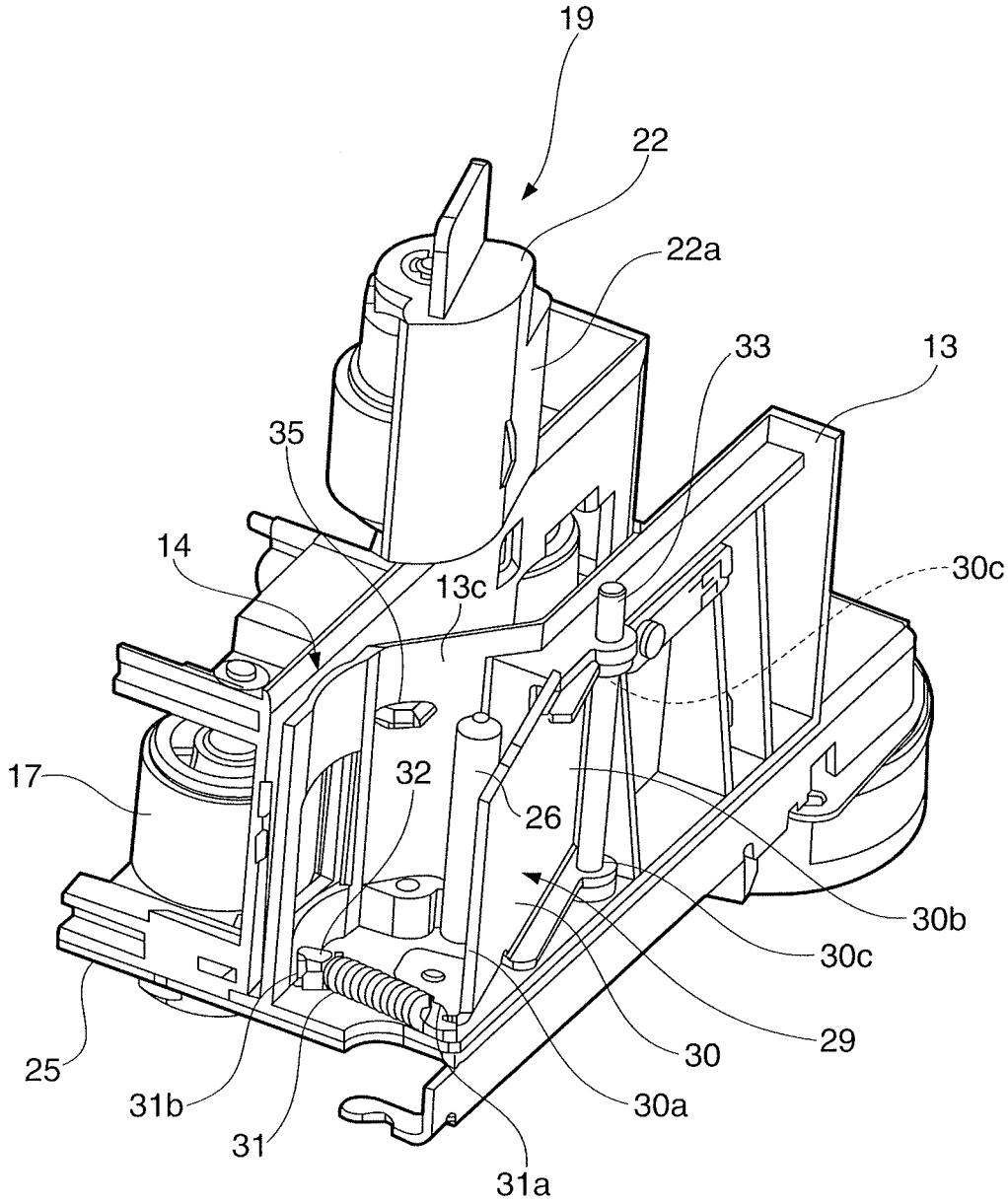
FIG. 6 is an exploded oblique view of the sheet feeder mechanism when seen in the direction of arrow VI in FIG. 5.

FIG. 6 is an oblique view of the sheet feeder mechanism 10 from the direction of arrow VI in FIG. 5. As shown in the figure, the pressure spring 31 is installed with one end 31*a* attached to one end 30*a* of the pressure plate 30, and the other end 31*b* attached to a catch 32 disposed to the base 25 of the sheet feeder mechanism 10. Mounting holes 30*c* are disposed with a gap therebetween at the top and bottom of the other end 30*b* of the pressure plate 30, and a post 33 rising from the sheet feeder mechanism 10 passes through the mounting holes 30*c*. As a result, the pressure plate 30 can rock on the post 33 and is constantly urged by the pressure spring 31 toward the in-feed path 14. In this case, the back of the case 22 (the opposite side as the in-feed path 14) of the retard unit 19 is formed as a contact surface 22*a* that contacts the pressure plate 30, enabling the urging force of the pressure spring 31 to be transferred uniformly to the case 22 through the pressure plate 30.

Next, as shown in FIG. 6, a protrusion 35 is disposed to the side wall 13*c* near where the retard unit 19 is installed to the second member 13. This protrusion 35 functions as a stop that prevents the retard unit 19 installed to the sheet feeder mechanism 10 from rising as a result of an engaging part 22*b* (see FIG. 5) disposed to the case 22 of the retard unit 19 engaging this protrusion 35 from below. Note that the protrusion 35 and case 22 are configured so that they mutually engage when the retard unit 19 is urged by the urging means 29 and pivots in the direction of arrow B in FIG. 3 and FIG. 4, and separate and disengage when the retard unit 19 pivots in the opposite direction as arrow B.

Operation of the sheet feeder mechanism 10 in this check processing device 1 is described next.

The retard roller 20 of the sheet feeder mechanism 10 is normally pushed to the feed roller 17 by the urging force of the pressure spring 31 acting on the retard unit 19 through the pressure plate 30. When the pickup roller 16 operates, one of the sheets 3 stored standing on edge in the hopper 4 is moved to the in-feed path 14, and the leading end of the sheet 3 enters between the feed roller 17 and retard roller 20. Because friction equal to the friction between the feed roller 17 and sheet 3 normally works between the sheet 3 and the retard roller 20 when the sheet 3 passes between the feed roller 17 and retard roller 20, the retard roller 20 rotates in conjunction with sheet 3 conveyance driven by the friction between the sheet 3 and retard roller 20.

However, when sheets 3 are multifed between the feed roller 17 and retard roller 20, the sheet 3 on the feed roller 17 side is conveyed by friction with the feed roller 17, but because sufficient friction is not produced between the sheet 3 on the feed roller 17 side and the sheet 3 on the retard roller 20 side, sufficient conveyance force from the feed roller 17 is not transferred to the sheet 3 on the retard roller 20 side. Because the retard roller 20 is connected to a torque limiter 21 and configured so that it will not turn when torque less than a specific level is applied, the conveyance force acting on the sheet 3 on the retard roller 20 side will not be sufficient to cause the retard roller 20 to turn even if transferred to the retard roller 20. As a result, the retard roller 20 works to restrain the sheet 3 on the retard roller 20 side. Note that a device in which the torque limit allowing rotation is appropriately set to prevent sheet 3 multifeeding is used as the torque limiter 21.

Because a load is frequently applied to the retard roller 20, the retard roller 20 gradually wears through use, and when the retard roller 20 becomes worn, the retard roller 20 can be easily replaced by simply removing the existing retard unit 19 and installing a new one. To remove the retard unit 19, the cover of the check processing device 1 is opened to expose the sheet feeder mechanism 10 to the outside, and the pressure plate 30 is then moved away from the feed roller 17 (the opposite direction as arrow B in FIG. 3 and FIG. 4) to relieve the urging force of the pressure spring 31 on the retard unit 19. Because the engaging part 22*b* and protrusion 35 can then be disengaged by moving the retard unit 19 slightly away from the feed roller 17, the retard unit 19 can be easily lifted up and removed by holding the grip 28.

A new retard unit 19 can be installed by reversing these steps. When the retard unit 19 is installed by inserting the post 26 into the insertion hole 24, the retard unit 19 is urged by the urging means 29, the retard roller 20 is pressed against the feed roller 17, and the protrusion 35 contacts the contact surface 22*a* of the case 22 of the retard unit 19. As a result, the retard unit 19 is prevented from rising, and the retard unit 19 can be easily installed to the specified position.

As described above, the retard roller 20 can be replaced by replacing the complete retard unit 19 when the retard roller 20 becomes worn in a check processing device 1 according to this embodiment of the invention because the retard roller 20 is rendered as a retard unit 19 and is removably installed to the main unit 2. As a result, a drop in the performance of the check processing device 1 due to retard roller 20 wear can be prevented, and the life of the check processing device 1 can therefore be extended.

The retard unit 19 can also be easily installed to and removed from the main unit 2 by fitting the insertion hole 24 disposed to the case 22 of the retard unit 19 over a vertically disposed post 26. More specifically, because the post 26 is disposed rising vertically from the main unit 2, and the retard unit 19 can be installed to the main unit 2 by fitting the insertion hole 24 onto the post 26 from above, the retard unit 19 can be replaced from above where the working space is large, and replacement is easy.

Furthermore, because the retard unit 19 is configured to pivot on a post 26, and the urging means 29 that urges the retard roller 20 to the feed roller 17 includes a pressure plate 30 and a pressure spring 31 that urges the pressure plate 30 to the feed roller, even pressure can be applied by the pressure plate 30 to the retard unit 19 even if the position of the retard unit 19 shifts slightly. A high precision assembly is therefore not required, and design freedom is high. In addition, because the pressure plate 30 is supported freely pivotably, only one pressure spring 31 is needed and the parts cost can be suppressed.

Furthermore, because a protrusion 35 that contacts and prevents the retard unit 19 from rising is disposed to the main unit 2, the retard unit 19 can be prevented from separating and moving up, and the retard roller 20 can function consistently.

Furthermore, because the sheets 3 stand on edge in the hopper 4 and the sheets 3 are conveyed standing upright to the in-feed path 14 in this check processing device 1, the retard unit 19 can be disposed with the axis of the retard roller 20 vertical, and the installation structure of the retard unit 19 described above can be easily achieved.

Furthermore, because at least part of the retard unit 19 is disposed between the first part 13*a* and second part 13*b* of the second member 13 as seen from the sheet 3 feeding direction (arrow A in FIG. 3), the size of the sheet feeder mechanism 10 in the horizontal direction where numerous devices are installed along the conveyance path 5 can be reduced. As a result, the overall size of the check processing device 1 can be reduced.

Furthermore, because the rotational axis of the retard roller 20 and torque limiter 21 is parallel to the post 26, the retard unit 19 pivots on the post 26 perpendicularly to the rotational axis of the retard roller 20 and torque limiter 21. The retard unit 19 can therefore pivot while pressing the retard roller 20 appropriately to the feed roller 17.

Furthermore, because the retard roller 20 and torque limiter 21 are disposed vertically coaxial, the retard unit 19 is not large in horizontally where numerous devices are disposed along the conveyance path 5, and fits neatly inside the main unit 2. This helps reduce the overall device size.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. An image processing device that performs at least one of forming an image on sheets and reading an image from sheets, comprising:

a main unit;

a sheet storage unit that is disposed to the main unit and holds the sheets in a stack;

a conveyance path for conveying the sheets in the sheet storage unit;

a feed roller disposed facing the conveyance path; and a retard unit including a retard roller disposed opposite the feed roller with the conveyance path therebetween, and a torque limiter coaxially connected to the retard roller; wherein the image processing device is configured to urge the retard unit so that the retard roller presses against the feed roller;

the retard unit is removably installed to the main unit;

the main unit has a shaft extending in a direction intersecting the sheet conveyance direction;

an insertion hole is disposed to the retard unit; and the retard unit is supported pivotably on the shaft by inserting the shaft to the insertion hole.

2. The image processing device described in claim 1, wherein:

the shaft is disposed protruding up from the main unit; and the retard unit is installed to the main unit by fitting the insertion hole onto the shaft from above.

3. The image processing device described in claim 1, wherein:

the image processing device includes a pressure plate that pushes the retard unit from the back side toward the feed roller, and an elastic member that urges the pressure plate toward the feed roller, thereby urging the retard unit so that the retard roller presses against the feed roller.

4. The image processing device described in claim 1, further comprising:

a stop that is disposed to the main unit, and contacts the retard unit and prevents the retard unit from rising.

5. The image processing device described in claim 4, wherein:

the device urges the retard unit and engages a stop.

6. The image processing device described in claim 1, wherein:

the sheet storage unit stores the sheets upright; and the sheets are fed upright into the conveyance path.

7. The image processing device described in claim 1, wherein:

the main unit has a first member with a vertical panel portion, and a second member disposed along the panel portion;

the second member has a first part disposed opposite the panel portion with the space therebetween forming the sheet storage unit, and a second part disposed opposite the panel portion with the space therebetween forming the conveyance path; and the retard unit is disposed with at least part thereof located between the first part and the second part when seen from the sheet conveyance direction.

8. The image processing device as described in claim 1, wherein:

the main unit has a shaft extending in a direction intersecting the sheet conveyance direction;

an insertion hole is disposed to the retard unit; and the retard unit is supported pivotably on the shaft by inserting the shaft to the insertion hole.

9. The image processing device as described in claim 1, wherein:

the shaft is disposed protruding up from the main unit; and the retard unit is installed to the main unit by fitting the insertion hole onto the shaft from above.

10. A sheet feeder mechanism for separating and feeding sheets stored in a stack in a main unit to a sheet conveyance path, comprising:

a feed roller that is rotationally driven in the sheet feeding direction;

a retard roller that contacts the feed roller from a position with the sheet conveyance path therebetween;

a torque limiter that is connected to the retard roller and restricts rotation of the retard roller by torque less than or equal to a specific level;

a case that holds the retard roller and torque limiter coaxially rotatable, wherein the sheet feeder mechanism is configured to urge the case in a specific direction toward the feed roller; and an installation mechanism that enables removably installing the case to the main unit while enabling the case to pivot in the specific direction, wherein the installation mechanism includes a shaft disposed to the main unit, and an insertion hole that is disposed to the case and enables inserting the shaft thereto.

11. The sheet feeder mechanism described in claim 10, wherein:

the shaft is disposed vertically.

12. The sheet feeder mechanism described in claim 10, wherein:

rotational axis of the retard roller and torque limiter is parallel to the shaft.

13. The sheet feeder mechanism described in claim 10, wherein:

the sheet feeder mechanism includes a pressure plate that contacts the case from the specific direction, and a pressure spring disposed between the pressure plate and the main unit, thereby urging the case in a specific direction toward the feed roller.

14. The sheet feeder mechanism described in claim 13, wherein:

the pressure plate is pivotably attached to the main unit.

15. The sheet feeder mechanism described in claim 13, wherein:

a contact surface that contacts the pressure plate is disposed to the case.

16. An image processing device that performs at least one of forming an image on sheets and reading an image from sheets, comprising:

a main unit;

a sheet storage unit that is disposed to the main unit and holds the sheets in a stack;

a conveyance path for conveying the sheets in the sheet storage unit;

a feed roller disposed facing the conveyance path; and a retard unit including a retard roller disposed opposite the feed roller with the conveyance path therebetween, and a torque limiter coaxially connected to the retard roller; wherein the device is configured to urge the retard unit so that the retard roller presses against the feed roller;

the retard unit is removably installed to the main unit; and the device urges the retard unit and engages a stop.

17. The image processing device described in claim 16, wherein:

the stop is disposed to the main unit, and contacts the retard unit and prevents the retard unit from rising.

* * * * *